US010654621B2

(12) United States Patent
Sargin

(10) Patent No.: US 10,654,621 B2
(45) Date of Patent: May 19, 2020

(54) METHOD AND SYSTEM FOR MAKING A STEPPED END

(71) Applicant: Coating Excellence International LLC, Wrightstown, WI (US)

(72) Inventor: Gary F. Sargin, Green Bay, WI (US)

(73) Assignee: Coating Excellence Internationl, LLC, Wrightstown, WI (US)

( * ) Notice: Subject to any disclaimer, the term of this patent is extended or adjusted under 35 U.S.C. 154(b) by 474 days.

(21) Appl. No.: 14/755,681

(22) Filed: Jun. 30, 2015

(65) Prior Publication Data

US 2015/0298418 A1 Oct. 22, 2015

Related U.S. Application Data

(63) Continuation of application No. 13/364,473, filed on Feb. 2, 2012, now Pat. No. 9,073,281, which is a continuation-in-part of application No. 13/016,096, filed on Jan. 28, 2011, now Pat. No. 8,535,209.

(60) Provisional application No. 61/439,015, filed on Feb. 3, 2011, provisional application No. 61/326,746, filed on Apr. 22, 2010.

(51) Int. Cl.

| | |
|---|---|
| ***B31B 70/81*** | (2017.01) |
| ***B65D 30/20*** | (2006.01) |
| ***B65D 33/22*** | (2006.01) |
| *B31B 70/20* | (2017.01) |
| *B31B 160/20* | (2017.01) |
| *B31B 150/00* | (2017.01) |

(52) U.S. Cl.

CPC ..... *B65D 31/10* (2013.01); *B65D 33/22* (2013.01); *B31B 70/20* (2017.08); *B31B 70/813* (2017.08); *B31B 2150/00* (2017.08); *B31B 2150/003* (2017.08); *B31B 2160/20* (2017.08)

(58) Field of Classification Search

CPC ..... B31B 2150/00; B31B 70/14; B31B 70/16; B31B 70/266; B31B 2510/003; B31B 2155/003; B31B 2160/20; B31B 70/20; B31B 70/261; B65D 31/10; B65D 33/22

USPC ..... 70/20

See application file for complete search history.

(56) References Cited

U.S. PATENT DOCUMENTS

| | | | | |
|---|---|---|---|---|
| 4,008,850 A * | 2/1977 | Goodrich | B65D 31/02 383/109 |
| 4,142,667 A * | 3/1979 | Runo | B65D 33/18 383/114 |
| 4,498,192 A * | 2/1985 | Becker | B65D 31/10 383/114 |
| 4,677,007 A * | 6/1987 | Murray | B65D 31/00 428/35.2 |

(Continued)

*Primary Examiner* — Christopher R Harmon
(74) *Attorney, Agent, or Firm* — Duane Morris LLP

(57) ABSTRACT

A method and apparatus for making a stepped end on a tube of flexible material includes a tube slitting station having a slitting tool with double edge slitting to provide respective slits beside a first panel and beside a second panel, respectively; a first trimming station trimming a first panel of the tube to a first shortened length, a second trimming station trimming the side gussets to a second length, wherein the second length is longer than the first shortened length; and an adhesive applying station applying adhesive on the tube above and below a fold line across the tube, wherein the tube is adapted to be folded along the fold line, and the adhesive material is adapted to form an adhesive to adhesive seal above and below the fold line.

5 Claims, 14 Drawing Sheets

(56) References Cited

U.S. PATENT DOCUMENTS

| | | | | | |
|---|---|---|---|---|---|
| 4,727,706 | A * | 3/1988 | Beer | B65D 31/04 | 53/434 |
| 5,615,979 | A * | 4/1997 | Lin | E21D 11/157 | 405/288 |
| 5,749,203 | A * | 5/1998 | McGowan, Jr. | B65B 31/028 | 53/432 |
| 6,534,137 | B1 * | 3/2003 | Vadhar | B32B 27/32 | 428/34.9 |
| 7,731,425 | B2 * | 6/2010 | Lin | B65D 31/02 | 383/117 |
| 2007/0274614 | A1 * | 11/2007 | Abel | B29C 66/1122 | 383/126 |
| 2010/0098355 | A1 * | 4/2010 | Jansen | B65D 33/1691 | 383/121 |
| 2010/0158418 | A1 * | 6/2010 | Jansen | B65D 33/22 | 383/211 |

* cited by examiner

METHOD AND SYSTEM FOR MAKING A STEPPED END

CROSS REFERENCE TO RELATED APPLICATION

This application is a continuation of U.S. application Ser. No. 13/364,473 Filed Feb. 2, 2012, which is based on U.S. Provisional Application No. 61/439,015 Filed Feb. 3, 2011. Further, U.S. application Ser. No. 13/364,473 Filed Feb. 2, 2012 is a Continuation-in-Part of U.S. application Ser. No. 13/016,096 Filed Jan. 28, 2011, which is based on U.S. Provisional Application No. 61/326,746 filed Apr. 22, 2010.

FIELD OF THE INVENTION

The invention relates to a method and apparatus for making a stepped end on a tube of flexible material, wherein the stepped end is adapted to be closed to provide a closed end on a bag.

BACKGROUND

U.S. Pat. No. 6,800,051 B2 and U.S. Pat. No. 4,008,850 and US 2009/0159192 A1, respectively, disclose a method for making a bag having a staggered end also known as a stepped end. US 2009/0159192 A1 discloses a perforation line in a web of tubular film, along which perforation line a segment is severed from the web of tubular film to form a staggered end. The perforation line is formed in a flat web of film, after which the tubular film is formed by folding side parts so as to overlap, and then simultaneously inserting the side folds and affixing a longitudinal center weld. Scoring apparatus are disclosed in U.S. Pat. Nos. 4,273,550 and 5,840,002 to make creases in the film for folding the film.

US 2010/0029455 A1 discloses a fabric having a layer of woven plastic bands and at least one additional material layer, and the cutting capacity of a laser can be adjusted to a thickness of the material layers to provide a perforation line.

A perforation line in a flat web of film is unsuited for a tube. Instead of manufacturing a flat web of film having a perforation line, a continuous tube without a perforation line can be manufactured at a high production speed, followed by cutting the tube to a desired length at the high production speed. The tube can be seamless. Alternatively, the tube can have one or more longitudinal seams as disclosed by Coating Excellence LLC in US 20080187695 A1, U.S. application Ser. No. 12/019,407, filed Jan. 24, 2008. Then it would be desirable to manufacture a stepped end on the tube, wherein the stepped end is adapted to be closed to make a bag. However, a tube does not encompass a flat web of film. It follows, it would be desirable to manufacture a staggered end, also known as a stepped end, on a tube, in order to take advantage of high speed manufacture of the tube.

SUMMARY OF THE INVENTION

The invention relates to a method and apparatus for making a stepped end on a tube of flexible material, wherein the stepped end is adapted to be closed to provide a closed end on a bag.

A method of making a stepped end on a tube of flexible material includes slitting the tube adjacent an open end of the tube to provide first slits beside a first panel of the tube and to provide second slits beside a second panel of the tube; trimming the first panel to a first shortened length adjacent to the open end of the tube while the first slits separate the first panel from a remainder of the tube, wherein the remainder of the tube comprises side gussets and the second panel; trimming each of side gussets to a second shortened length adjacent to the open end of the tube while the second slits separate each of the side gussets from the second panel, wherein the second shortened length is longer than the first panel and shorter than the second panel; and applying adhesive material on the tube above and below a fold line across the tube, wherein the tube is adapted to be folded along the fold line, and the adhesive material is adapted to form an adhesive to adhesive seal above and below the fold line while the tube is folded to provide a closed stepped end for a bag.

An apparatus for making a stepped end on a tube of flexible material includes a tube slitting station having a slitting tool with double edge slitting blades penetrating through the tube to provide respective slits beside a first panel and beside a second panel, respectively; a first trimming station trimming a first panel of the tube to a first shortened length, a second trimming station trimming the side gussets to a second length, wherein the second length is longer than the first shortened length of the first panel; and an adhesive applying station applying adhesive on the tube above and below a fold line across the tube, wherein the tube is adapted to be folded along the fold line, and the adhesive material is adapted to form an adhesive to adhesive seal above and below the fold line while the tube is folded to provide a closed stepped end for a bag.

BRIEF DESCRIPTION OF THE DRAWINGS

Embodiments of the invention will now be described by way of example with reference to the accompanying drawings.

DETAILED DESCRIPTION

Figure 1:
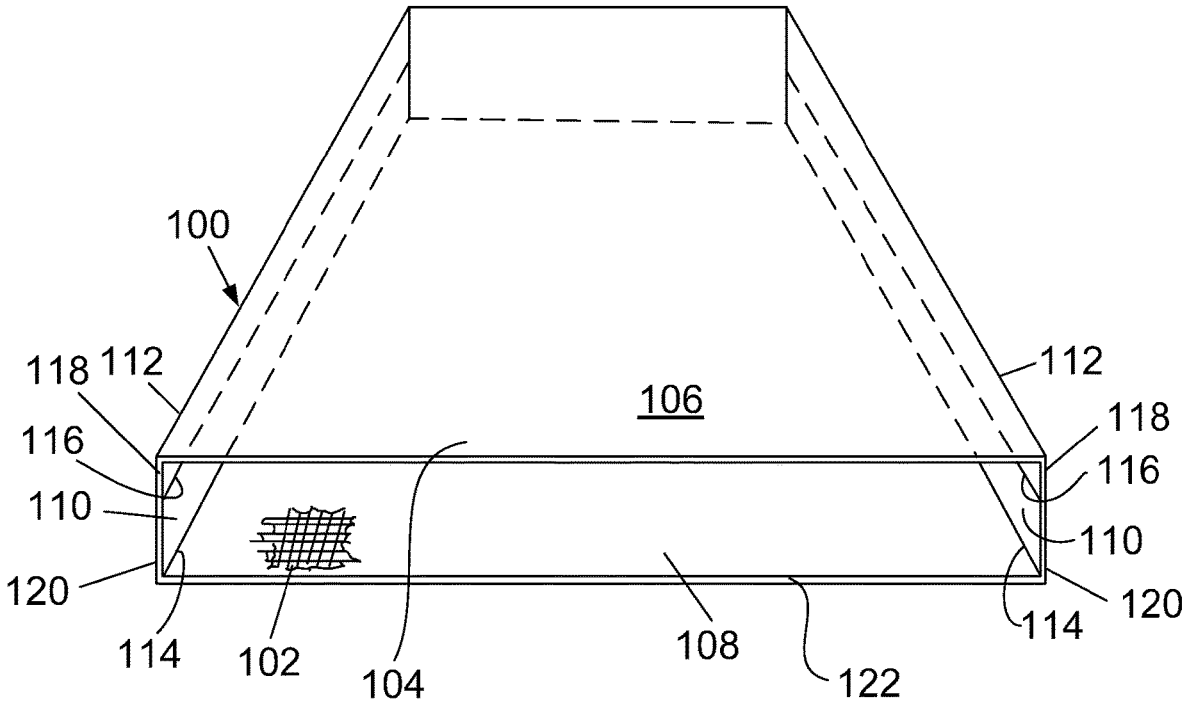
FIG. 1 is an isometric view of a tube having a first panel and a second panel, and side gussets, wherein the tube is adapted for making a bag.

FIG. 1 discloses a tube 100 of flexible polymeric material, wherein the tube 100 is formed with a first side gusset 110 and a second side gusset 110. Side edges 112, 112 of a first panel 106 are connected to the first side gusset 110 and the second side gusset 110, respectively. Side edges 114, 114 of a second panel 108 are connected to the first side gusset 110 and the second side gusset 110, respectively. The first side gusset 110 and the second side gusset 110 are foldable inward along longitudinal creases or folds 116, 116 to flatten the tube. The gussets 110, 110 fold or crease along the side edges 112, 112 and the side edges 114, 114.

FIG. 1 discloses the tube 100 having an open end 122 encircled by a first panel 106, a second panel 108 and the side gussets 110, 110. The first panel 106 refers to a front panel of the bag while the second panel 108 refers to a back panel of the bag. Alternatively, the first panel 106 refers to a back panel of the bag while the second panel 108 refers to a front panel of the bag.

Figure 2:
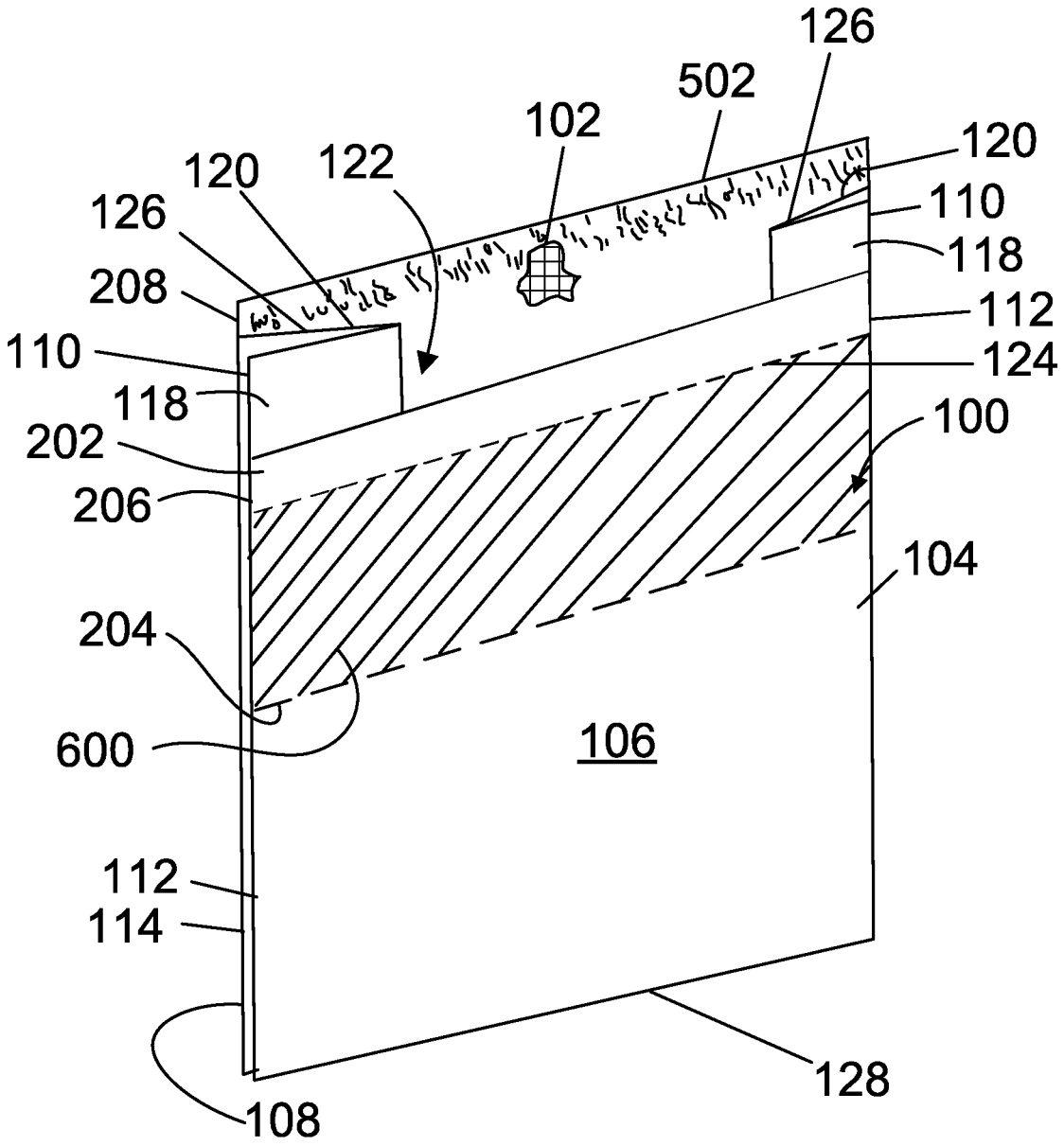
FIG. 2 is an isometric view of a tube manufactured with a stepped end.
Figure 2A:
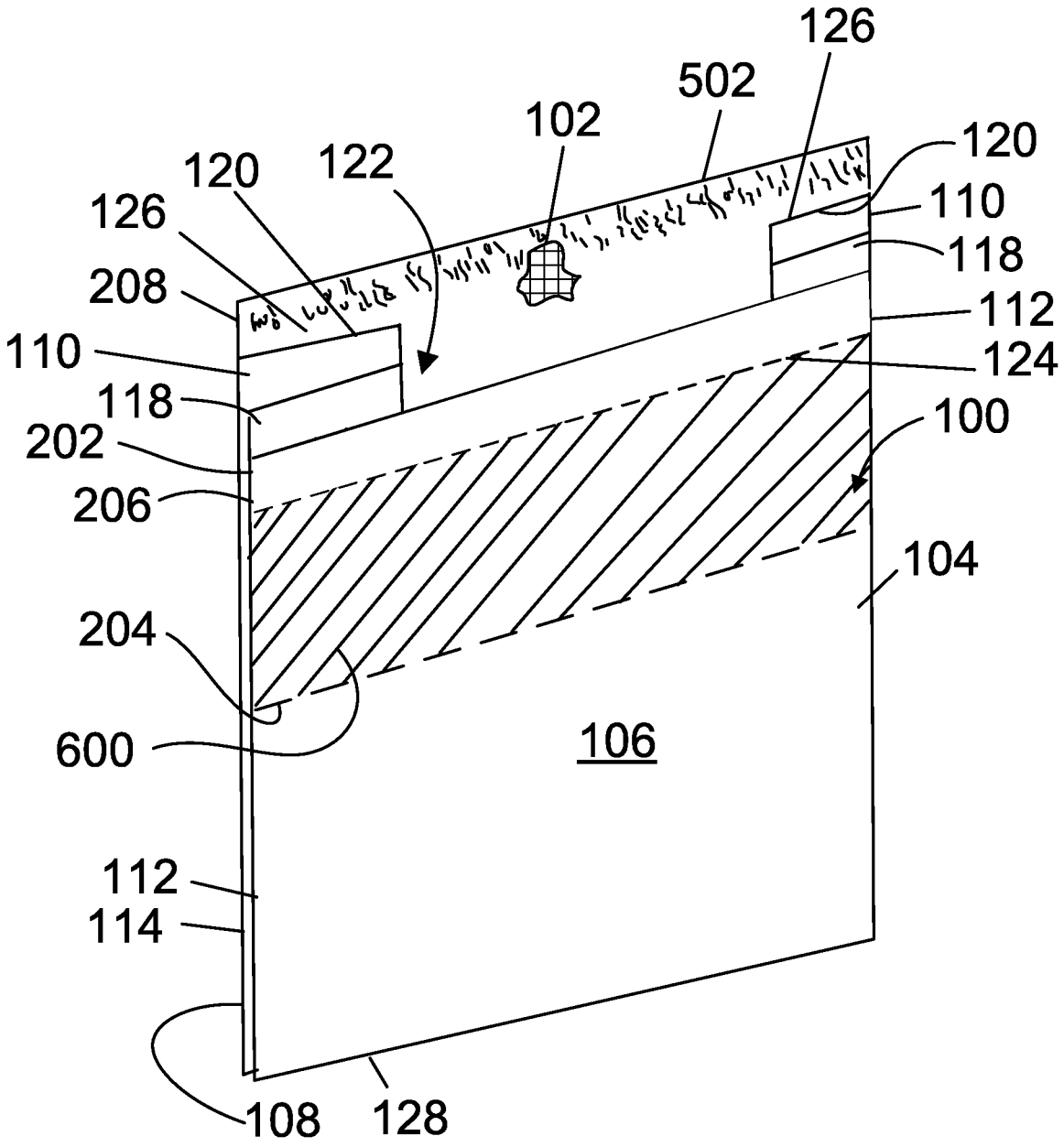
FIG. 2A is an isometric view of another embodiment of a tube manufactured with a stepped end.

In FIG. 2 and FIG. 2A, respective first sections 118, 118 of the side gussets 110, 110 are adjacent to the first panel 106. Respective second sections 120, 120 of the side gussets 110 are adjacent to the second panel 108. The side gussets 110 are folded along the folds 116. The first sections 118 and the second sections 120 fold inwardly along the folds 116, and are in an inwardly folded orientation between the first panel 106 and the second panel 108 while the tube 100 is flat. Each side gusset 110 is adapted to unfold outwardly from between the first panel 106 and the second panel 108 to expand the bag interior. In an embodiment of FIG. 2A, the second sections 120, 120 of the side gussets 110, 110 are shorter than the first sections 118, 118 of the side gussets 110, 110, and are made as described with reference to FIGS. 8 and 9.

An embodiment of the tube 100 is formed as a laminated tube 100 that has a woven inner layer 102, a portion of which is illustrated to comprise a tight basket weave of thin, flexible, elongated strips of a polymeric material, for example, polypropylene. The inner layer 102 advantageously comprises a woven seamless tube that is highly flexible due to the weave. The laminated tube 100 has at least one outer layer 104 of a printable nonwoven polymeric material, for example, polypropylene film that is capable of being printed with graphics using water based pigments or solvent based pigments.

In an embodiment of the invention, the outer layer 104 is reverse printed on an inside surface of a first polypropylene film. In another embodiment, a second layer of polypropylene film is laminated to the first polypropylene film, with the printed surface between the first and second layers of polypropylene film. Alternatively, the second layer of polypropylene film can be printed with the graphics.

After printing, the outer layer 104, and each second layer of polypropylene film, if present, and the woven inner layer 102 are laminated, for example, by applying a solventless adhesive material or solvent based adhesive material between the layers to be laminated, and applying heat and pressure to laminate each outer layer 104, second layer and the inner layer 102 and form the continuous laminated tube 100. The woven inner layer 102 can be seamless tubular, while the outer layer 104 and each second layer of polypropylene film can overlap and form a lengthwise closed seam, that is adhesively sealed shut to form a seamed tubular construction, further described by US 20080187695 A1, U.S. application Ser. No. 12/019,407, filed Jan. 24, 2008.

Alternative embodiments of the tube 100 are fabricated with one or more nonwoven polypropylene films to provide a nonwoven inner layer 102 and a nonwoven outer layer 104.

Further embodiments of the tube 100 comprise, a seamless blown tube, a seamless woven tube and a tube manufactured from flat sheets laminated together to form a seamed tubular construction. Embodiments of the tube comprise, a seamless blown tube, a seamless woven tube and a tube manufactured from flat sheets laminated together to form a seamed tubular construction. Further, a particular embodiment of a tube includes a seamless woven tube of polypropylene or other polyolefin material, which is desired for its tensile strength in order to package and store heavy contents in granular form, such as, dog food, cereals, grains and construction materials.

FIG. 2 discloses the tube 100 wherein the open end 122 of the bag is pinch closed by closing the first panel 106 and the second panel 108 against each other at their end edges adjacent the open end 122. The tube 100 is made with a stepped, or step cut construction at the open end 122, wherein a portion of the first panel 106 is removed by severing, cutting or hot knife, and wherein the first panel 106 is made shorter than a longer portion 502 of the second panel 108 at the open end. Further, a portion of each of the side gussets 110, 110 is removed, wherein the side gussets are made longer than the first panel 106 and shorter than the second panel 108. The longer portion 502 provides a foldable flap portion 502 on the second panel 108. As a result, a stepped end 122 is formed on the tube 100. Although the stepped end 122 is disclosed on an embodiment of the tube 100 in FIG. 1, the stepped end 122 can be made on any embodiment of a tube of flexible polymeric material intended for making a bag.

First, the tube 100 in FIG. 2 is made with a stepped end 122. After making the stepped end 122, a first layer 600 of an adhesive material is provided on the first panel 106 of the tube 100 below a fold line 206.

An apparatus and method will now be described for making the stepped end 122 of the tube 100. Advantageously the tube 100 eliminates a perforated line to make the stepped end. Further, advantageously the apparatus and method applies to any embodiment of a tube of flexible polymeric material intended for making a bag, including, but not limited to an embodiment of the tube 100 described in FIG. 1.

Figure 3:
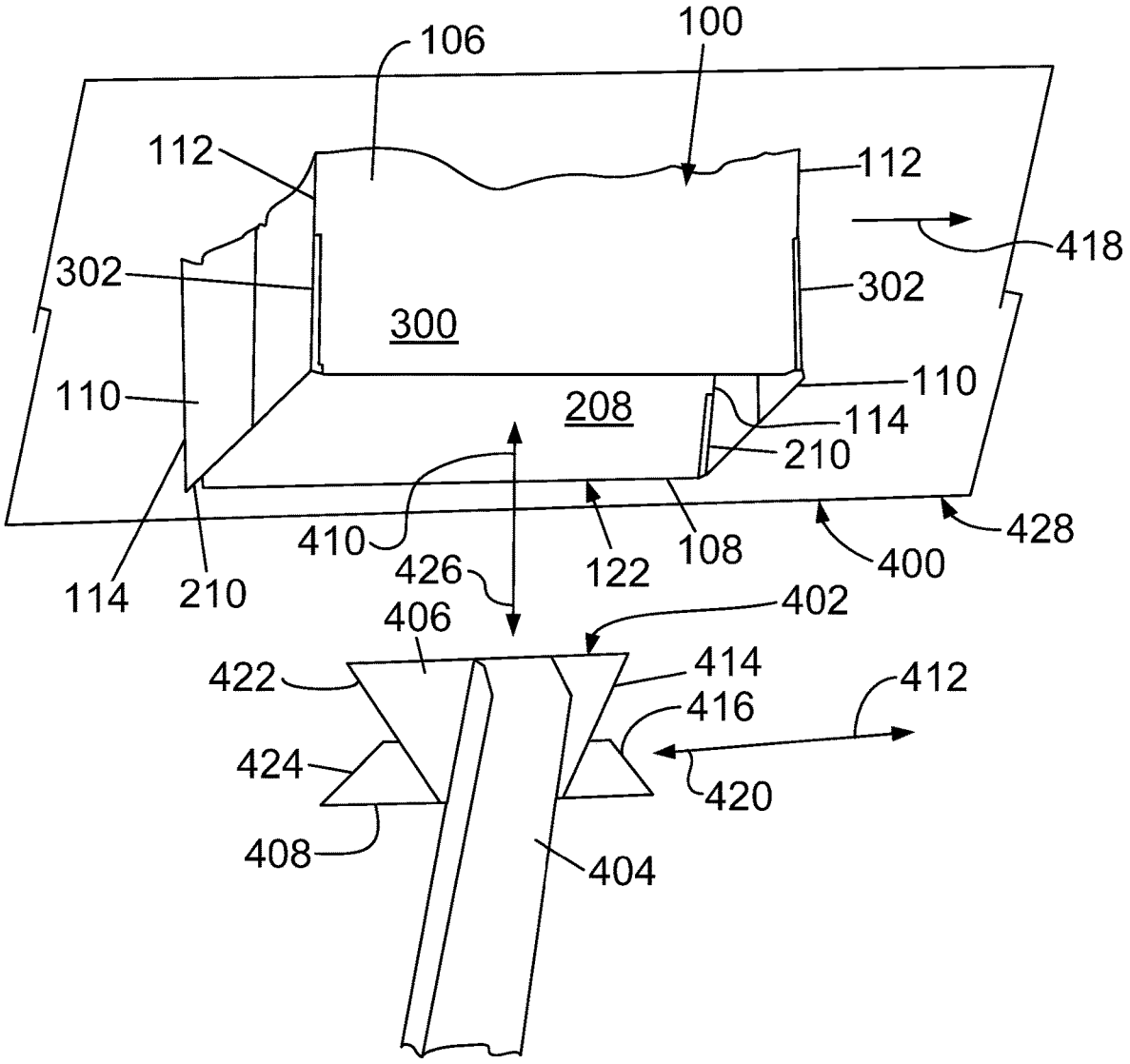
FIG. 3 is an isometric view of an apparatus for making a stepped end on a tube, and further disclosing a tube slitting station of the apparatus.

FIG. 3 discloses the tube 100 formed with a slit portion 208 of the second panel 108 adjacent to the open end 122 of the tube 100. The second panel 108 has first corresponding slits 210, 210 along the side edges 114, 114 thereof. The first corresponding slits 210, 210 are adjacent to the open end 122 and extend into the open end 122. The first corresponding slits 210, 210 separate the slit portion 208 of the second panel 108 from the side gussets 110, 110.

FIG. 3 discloses a slit portion 300 of the first panel 106 adjacent to the open end 122. The first panel 106 has second corresponding slits 302, 302 along the side edges 112, 112 thereof. The second corresponding slits 302, 302 are adjacent to the open end 122 and extend into the open end 122. The second corresponding slits 302, 302 separate the slit portion 300 from the side gussets 110, 110. FIG. 3 discloses the slits 302, 302 are longer than the shorter slits 210, 210.

FIG. 3 discloses the tube 100 in an apparatus 400. The tube 100 is conveyed, for example, by a continuous or intermittent or segmented belt conveyor 428, and is indexed into position in front of a slitting station 402. The slitting station 402 of the apparatus 400 is provided with a slitting tool 404 disclosed in its home position. The slitting tool 404 has spaced apart, double edge slitting blades 406, 408.

Although the slitting blades 406, 408 are disclosed as fixed flat blades, they can take the form of rotary blades or reciprocating blades.

In FIG. 3, the open end 122 of the tube 100 is opened and maintained open, for example, by blowing air under pressure into the open end 122 of the tube 100 or by surrounding the tube 100 in a suction chamber, not shown. While the tube 100 is open, the slitting tool 404 is initially in its home position disclosed by FIG. 3. Then, the slitting tool 404 is indexed or displaced from its home position toward and into the open end 122 of the tube 100, in a direction disclosed by the arrow 410, to a first tool position to insert the slitting blades 406, 408 into the open end 122 of the tube 100.

Then while the slitting tool 404 is inside the tube 100, the tool slitting 404 is indexed or displaced, relative to the tube 100, in a forward direction indicated by the forward pointing arrow 412. Thereby, the slitting tool 404 is indexed or displaced to a stationary second tool position while the slitting blades 406, 408 have forward slitting edges 414, 416 that perform slitting through a first pair of the side edges 112, 114 of the first panel 106 and the second panel 108, respectively. The forward slitting edges 414, 416 serve to provide a first pair of forward respective slits 210, 302 beside the panels 106, 108.

The tube 100 is conveyed or displaced in a forward direction indicated by the arrow 418, provided that the slitting tool 404 is displaced in a forward direction 412 faster, relative to forward displacement of the tube 100, while the forward slitting edges 414, 416 perform slitting through a first pair of the side edges 112, 114 of the first panel 106 and the second panel 108, respectively. Alternatively, the tube 100 can be stationary while the slitting tool 404 is displaced in a forward direction 412 while the forward slitting edges 414, 416 perform slitting through a first pair of the side edges 112, 114 of the first panel 106 and the second panel 108, respectively.

Then, while the tube 100 is being conveyed in a forward direction 418, the slitting tool 404 while inside the tube 100, and is indexed in a reverse or rearward direction indicated by the rearward pointing arrow 420, to return to its first tool position while inside the tube 100. The slitting blades 406, 408 have rearward slitting edges 422, 424 that perform slitting through a second pair of the side edges 112, 114 of the first panel 106 and the second panel 108, respectively. Thereby, the rearward slitting edges 422, 424 provide a second pair of the respective slits 302, 210 beside the panels 106, 108. Then the tube 100 continues in the forward direction 418, while the slitting tool 404 is being indexed in a rearward direction indicated by the rearward pointing arrow 426 to its home position shown in FIG. 2. The slitting tool 404 can bias the flexible gussets 110, 110 out of the way, as the slitting tool 404 returns to its home position disclosed in FIG. 3. The tube 100 continues to be conveyed in the forward direction 418, and leaves the slitting tool 404. By repeating the operation of the apparatus 400 as described herein, multiple tubes 100 in succession are provided with the slits 210 and 302.

Figure 4:
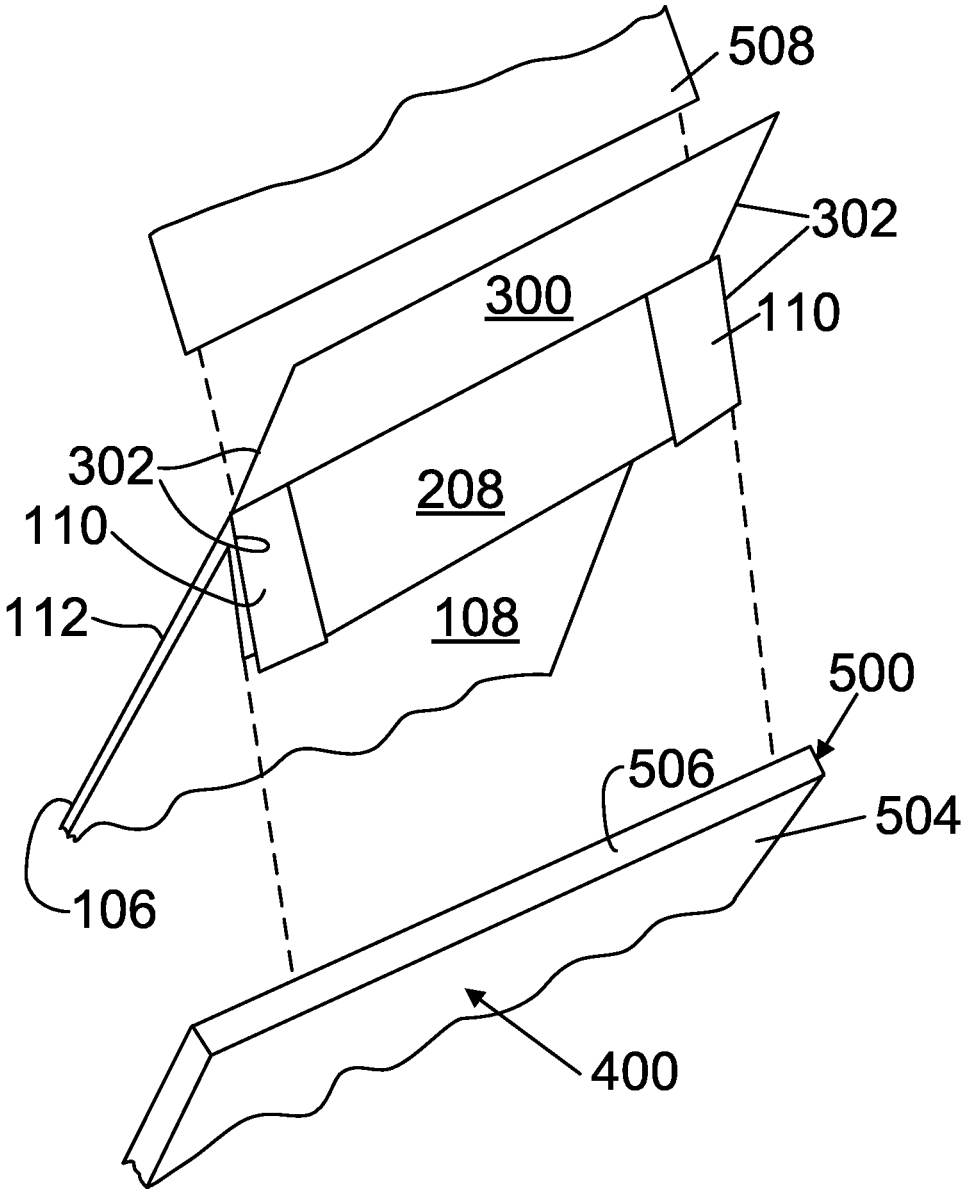
FIG. 4 is an isometric view of a first panel trimming station of the apparatus of FIG. 3.

FIG. 4 discloses the apparatus 400 having a first panel trimming station 500. The tube 100 continues to be conveyed by the belt conveyor 428 of FIG. 3 in a forward direction indicated by the arrow 418 in FIG. 3, such that belt conveyor 428 extends beyond the slitting station 402 of FIG. 3 to convey the tube 100 from the slitting station 402 of FIG. 3 to the first panel trimming station 500 of FIG. 4. At the first panel trimming station 500, the tube 100 is supported on a table or rotary knife anvil 504, disclosed in exploded configuration for clarity. The tube 100 is folded along an edge 506 of the table or anvil 504, which folds the side gussets 110, 110 and the slit portion 208 of the second panel 108, down and away from the slit portion 300 of the first panel 106. The slits 302, 302 separate the slit portion 300 of the first panel 106 from a remainder of the tube 100, wherein the remainder of the tube 100 includes the side gussets 110, 110 and the slit portion 208 of the second panel 108. The first panel trimming station 500 includes a cutting blade 508 which cuts through the first panel 106 and performs trimming. The terminology "trimming" means to shorten in length, by severing, cutting or hot knife, which is accomplished, for example, by a knife cutting blade or rotary cutting blade, pair of shears, punch press or an equivalent tool or machine.

Further, FIG. 4 discloses the side gussets 110, 110 being pivoted away from the slit portion 300 of the first panel 106. The slitted portion 208 of the second panel 108 is behind the pivoting gussets 110, 110. For this reason, the slitted portion 208 of the second panel 108 pivots and moves away with the side gussets 110, 110. Both the slitted portion 208 of the second panel 108 and the side gussets 110, 110 are folded downwardly away, while the first panel 106 is trimmed.

Figure 4A:
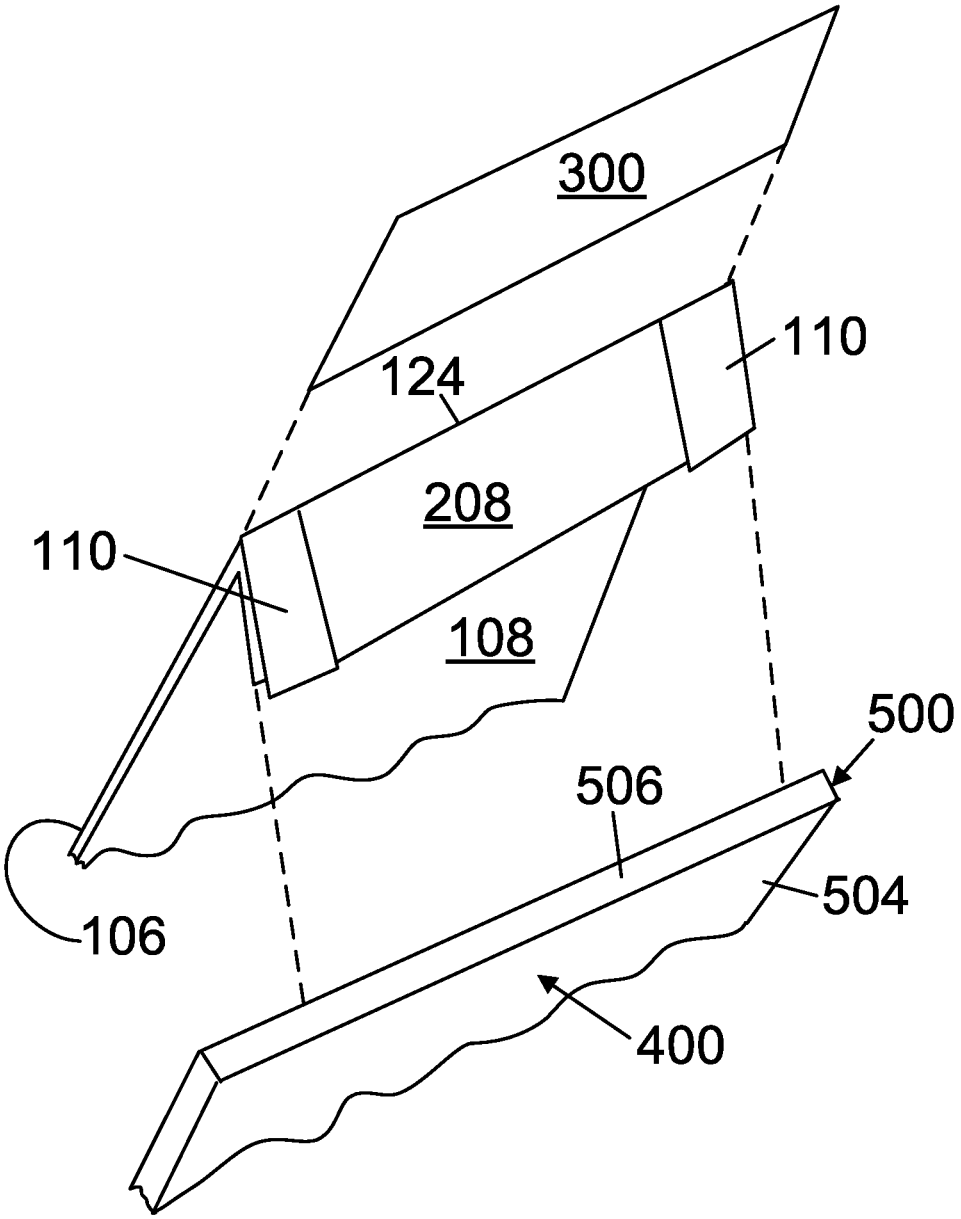
FIG. 4A is a view similar to FIG. 4, and further disclosing a shortened end of a first panel of the tube.

FIG. 4A discloses the slit portion 300 of the first panel 106 being removed and discarded. As a result, the first panel 106 is trimmed to a first shortened length 124. As disclosed by FIG. 2, the first shortened length 124 of the first panel 106 will be adjacent to the open end 122 of the tube 100.

Figure 5:
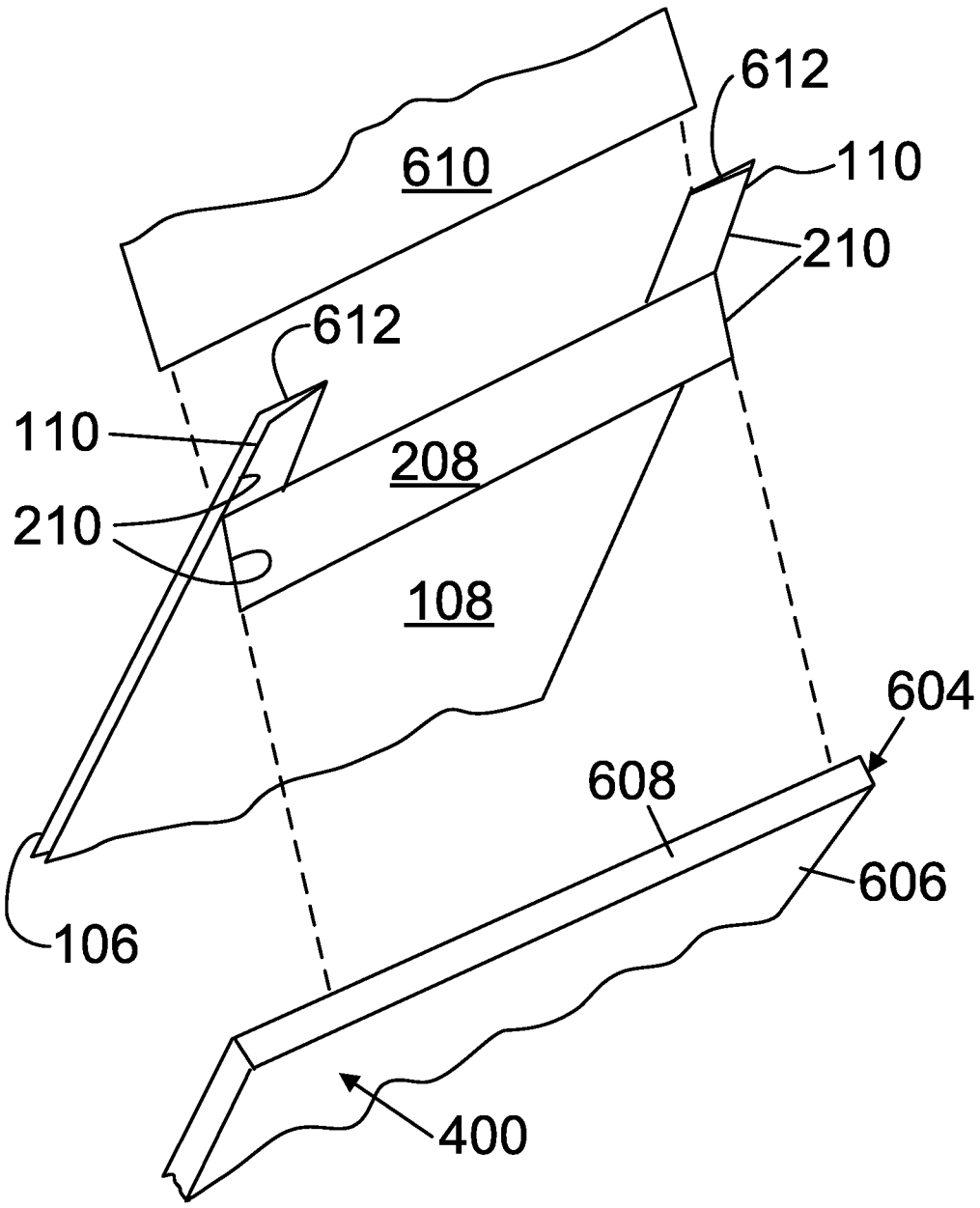
FIG. 5 is an isometric view of a second panel trimming station of the apparatus of FIG. 3.

FIG. 5 discloses the apparatus 400 having a second panel trimming station 604. The tube 100 continues to be conveyed by the belt conveyor 428 of FIG. 3 in a forward direction indicated by the arrow 418 in FIG. 3, such that belt conveyor extends beyond the slitting station 402 of FIG. 3 to convey the tube 100 from the slitting station 402 of FIG. 3 to the first panel trimming station 500 of FIG. 4, and then to the second panel trimming station 604 in consecutive order. The tube 100 is conveyed by the belt conveyor 428 of FIG. 4 from the first panel trimming station 500 of FIG. 4 to the second panel trimming station 604 of FIG. 5. At the second panel trimming station 604, the tube 100 is supported on a table or rotary knife anvil 606. The tube 100 is folded along an edge 608 of the table 604, which folds the slitted portion 208 of second panel 108, down and away from the side gussets 110, 110. The slits 210, 210 separate the side gussets 110, 110 from the remainder of the tube 100, wherein the remainder of the tube 100 includes the second panel 108, and especially the slit portion 208 of the second panel 108. The second trimming station 604 includes a cutting blade 610 which cuts through the side gussets 110, 110, and performs trimming to cut through the side gussets 110, 110 to cut and remove sections 612, 612 of the side gussets 110, 110.

Figure 5A:
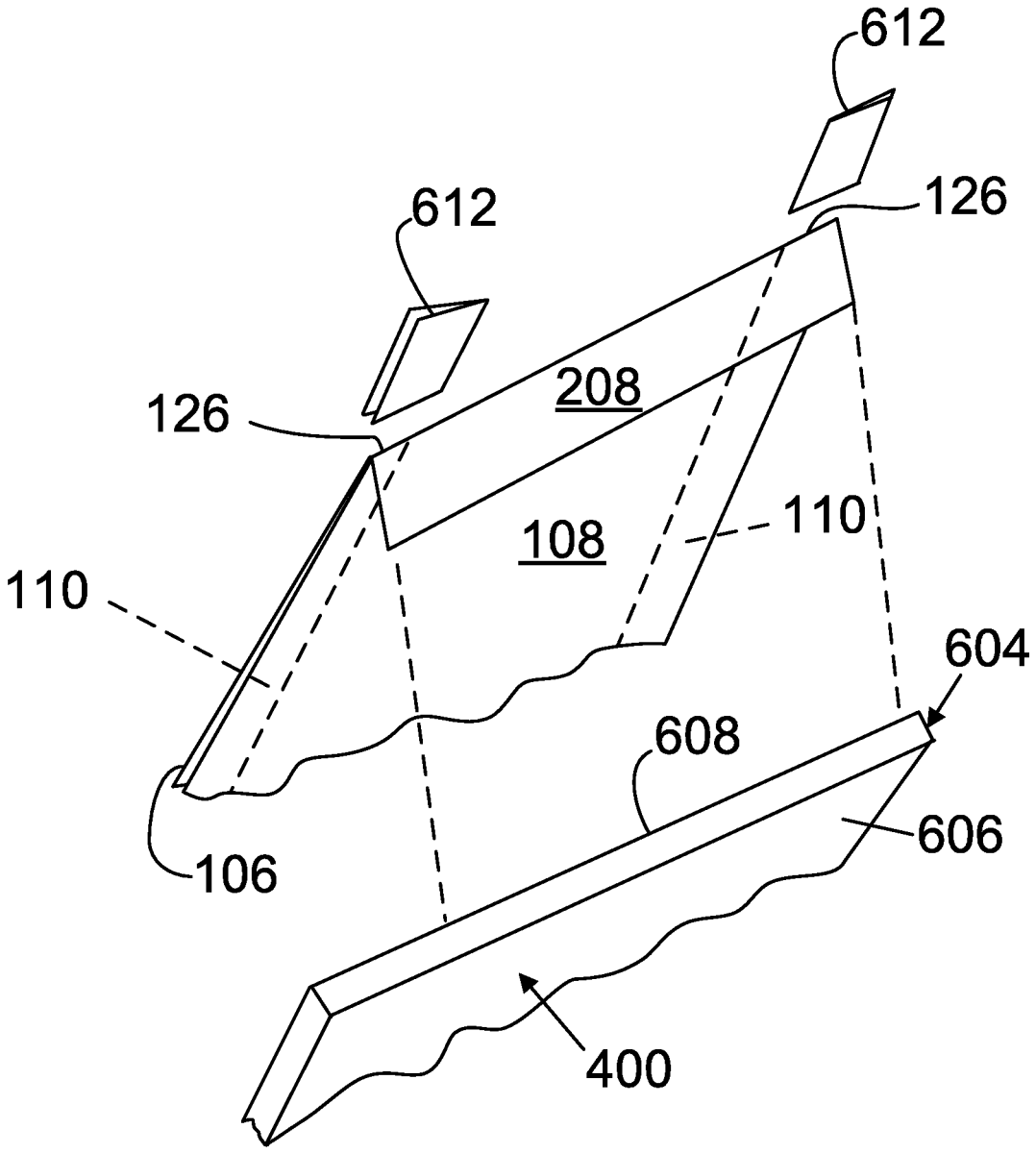
FIG. 5A is a view similar to FIG. 5, and further disclosing a shortened end on each of the side gussets of the tube.

FIG. 5A discloses the sections 612, 612 being removed and discarded. As a result, each of the side gussets 110, 110 are trimmed to a second shortened length 126, FIG. 2. As disclosed by FIG. 2, the second shortened length 126 of each of the side gussets 110, 110 will be adjacent to the open end 122 of the tube 100.

The side gussets 110, 110 become longer than the first panel 106 adjacent to the open end 122 of the tube 100, and the side gussets 110, 110 become shorter than the second panel 108 adjacent to the open end 122 of the tube 100, which comprises a stepped end 122 of the tube 100 FIG. 2. The second panel 108 provides a sealing flap portion 502 adjacent to the stepped end 122 of the tube 100. After formation of the stepped end 122 of the tube 100, the tube 100 is flattened by inwardly folding the side gussets 110, 110.

Figure 6:
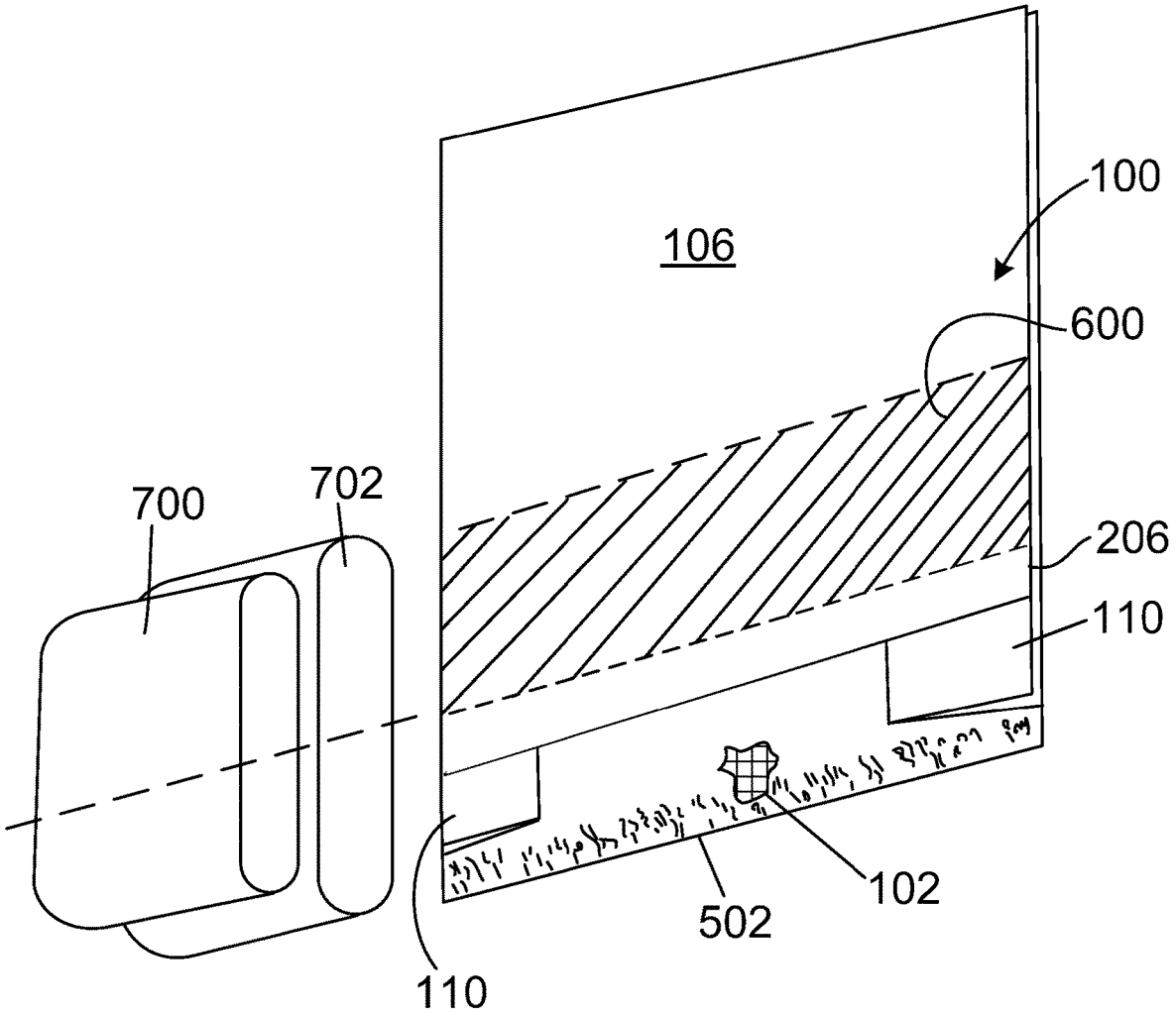
FIG. 6 is an isometric view of a creasing station and an adhesive applying station of the apparatus of FIG. 3.

In FIG. 6, a fold line 206 across the tube 100 indicates a line along which the tube 100 can be folded. To form the fold line 206 with an optional crease, the flattened tube 100 is conveyed through a scoring apparatus 700 of the apparatus 400, which provides a crease along the fold line 206 across the tube 100. A scoring apparatus 700 is disclosed in FIG. 6 in schematic representation of a commercially available scoring apparatus, for example, as disclosed in U.S. Pat. Nos. 4,273,550 and 5,840,002. As a result, the invention provides a method of making a stepped end 122 and a fold line 206 with an optional crease on a tube 100 of flexible material for a tubular bag.

Further, FIG. 6 discloses a method of making a tube 100 of flexible material with a stepped end 122 that folds to close the stepped end 122 and form a bag, and adhesive material applied as layers 600 for sealing the stepped end 122. FIG. 6 discloses a process of applying a layer 600 of adhesive material below the fold line 206. The adhesive material layer 600 is applied, while the tube 100 is flat, by an adhesive material applicator 702 including, but not limited to a roller, brush or spraying apparatus. The adhesive material layer 600 below the fold line 206 is applied as fluent compositions including emulsions or solutions constituted in a fluid including, but not limited to water or a chemical solvent. Then the adhesive material layer 600 is dried in a heated oven to drive off the fluent substances. The adhesive material layer 600 is capable of forming moisture and water resistant, heat activated adhesive-to-adhesive seals.

The adhesive-to-adhesive seal is formed by heating the adhesive material layer 600 below the fold line 206 to a melt flow temperature at which it attains a melt flow, adhesive state. The adhesive material layer 600 below the fold line 206 has a respective melt flow temperature of about 300° F. maximum to avoid heating the polymeric material of the tube 100 to its melt flow temperature above the 300° F. threshold temperature. The adhesive material corresponding to the adhesive layer 600 has a coating weight of at least 5-10 lb./ream on each of opposing surfaces to form an adhesive-to-adhesive seal between the opposing surfaces of about 10 lb./ream coating weight to about 20 lb./ream coating weight. The adhesive material layer 600 is activated to an adhesive state by applying heat at a heat activation temperature below the heat activation temperatures of standard or traditional hot melt adhesives or solvent based adhesives that can seal traditional paper and polymer laminated bags without damaging the paper layers, but which exceed the softening point temperature $T_g$ of polymeric bags 100 fabricated without paper layers. The standard or traditional hot melt adhesives cannot be combined with polypropylene bags 100 because the temperatures needed to activate the adhesives are destructive to the PP material structure.

Polypropylene has a melting point temperature of about 160° C. (320° F.), as determined by differential scanning calorimetry (DSC). The softening point temperature of polypropylene is below its melting point temperature. Thus, a polypropylene tube 100 can be heated to a temperature below its softening point temperature without causing heat damage of the polypropylene material.

One suitable adhesive material for heat sealing polyolefin films of the tube 100 comprises a water based emulsion of triethylamine adhesive commercially available as AQUAGRIP® 19566F, manufactured by Bostik, Inc., 11320 Watertown Plank Road, Wauwatosa, Wis. 53226 USA. Another embodiment of a hot melt adhesive for heat sealing polyolefin films of the tube 100 comprises a hot melt adhesive H9463 available commercially from Bostik, Inc. Wauwatosa, Wis. 53226, USA. Another embodiment of a hot melt adhesive for heat sealing polyolefin films of the tube 100 comprises a hot melt adhesive H9477 Generation II of H9463, now or soon to be available commercially from Bostik, Inc., Wauwatosa, Wis. 53226, USA, wherein the adhesives per se form no part of the present invention separate from being a structural component of the tubes disclosed herein.

Another embodiment of a suitable adhesive material for heat sealing polyolefin films of the tube 100 comprises an aqueous based dispersion or emulsion as an opaque liquid or fluid of an ethylene copolymer or ethylene copolymers, butyl acetate and acetaldehyde, which is commercially available as the product name ROBOND™ HS 37-140 adhesive material manufactured by Rohm and Haas Company, 100 Independence Mall West, Philadelphia, Pa. 19106-2399 USA. Another embodiment of a suitable adhesive material for heat sealing polyolefin films of the tube 100 comprises an aqueous based dispersion or emulsion as an opaque liquid or fluid, including an ionomer dispersion in water, based upon Surlyn® ionomer resin, and which can be diluted or thickened or crosslinked for enhanced properties, and which is commercially available as the product name ADCOTE™ 37-220 Heat Seal Coating, manufactured by Rohm and Haas Company, 100 Independence Mall West, Philadelphia, Pa. 19106-2399 USA, wherein the adhesives per se form no part of the present invention separate from being a structural component of the tubes disclosed herein.

Another embodiment of a suitable adhesive material for heat sealing polyolefin films of the tube 100 comprises an aqueous based dispersion or emulsion as an opaque liquid or fluid, including water, acrylic polymer, polyester polyurethane resin, formaldehyde, ammonium hydroxide, alumina and further including ammonia as a combustion product, which is commercially available as the product name NWC 23526K (and NWC 23526KC) FDA WATER BASE HEAT SEAL FOR POLYWOVEN™ adhesive material, product code 728575, manufactured by ASHLAND Inc., P.O. Box 2219, Columbus, Ohio 43216, USA, wherein the adhesive per se forms no part of the present invention separate from being a structural component of the tubes disclosed herein.

Another embodiment of a suitable adhesive material for heat sealing polyolefin films of the tube 100 comprises a liquid state, acrylated epoxy based adhesive commercially available as the product name, VERSA-WELD™ 70-7879, adhesive material manufactured by Henkel Corporation, P.O. Box 6500; 10 Finderline Avenue, Bridgewater, N.J. 08807 USA, wherein the adhesive per se forms no part of the present invention separate from being a structural component of the tubes disclosed herein.

The embodiments of adhesive material 600 as a structural component of the bags includes 1.75 grams adhesive material per bag applied wet, solubilized in water, assuming an 18 inch wide bag and a 3 inches wide stripe of adhesive on the bag, which is equivalent to 0.6 grams per bag dry or about 10.6 lbs per ream dry weight coating. Once the adhesive material 600 is applied, it must pass under a drying system to evaporate the water and dry the adhesive layer to a stable state impervious to water, water vapor and ambient temperatures.

The tube 100 is adapted to be closed and sealed at one end 122 to make a bag, according to a process described as follows, a heat source including, but not limited to heated air or a hot bar applies heat to activate the adhesive material 600 to its respective, heat-activatable adhesive state. While the adhesive material 600 is in an adhesive state, the source of heat is removed and the end 122 of the tube 100 is folded on the fold line 206, while the tube 100 is pinched closed to close and seal one end 122 of the tube 100 to make a bag with one closed end 122, while an opposite end 128 is open. According to another embodiment, the tube 100 is open at the end 122, and is closed and sealed at the opposite end 128, by any known means, for example, stitching or gluing. The foldable tube 100 is flattened by folding along its gusseted side panels 110 for shipping and handling, in preparation for shipment to a location where the tube 100 is opened at one end 122 and filled with contents. The adhesive material layer 600 is in its dry, solidified state during bag filling, and is moisture and water resistant, by which the adhesive material layer 600 avoids contamination of the bag contents. After the tube 100 has been filled with contents, the tube 100 is closed and sealed at the end 122, according to a process described as follows, a heat source including, but not limited to heated air or a hot bar applies heat to activate the adhesive material 600 to its respective, heat-activatable adhesive state. While the adhesive material 600 is in its adhesive state, the source of heat is removed and the end 122 of the tube 100 is folded on the fold line 206, while the tube 100 is pinched closed to hold the contents in the tube 100.

Figure 7:
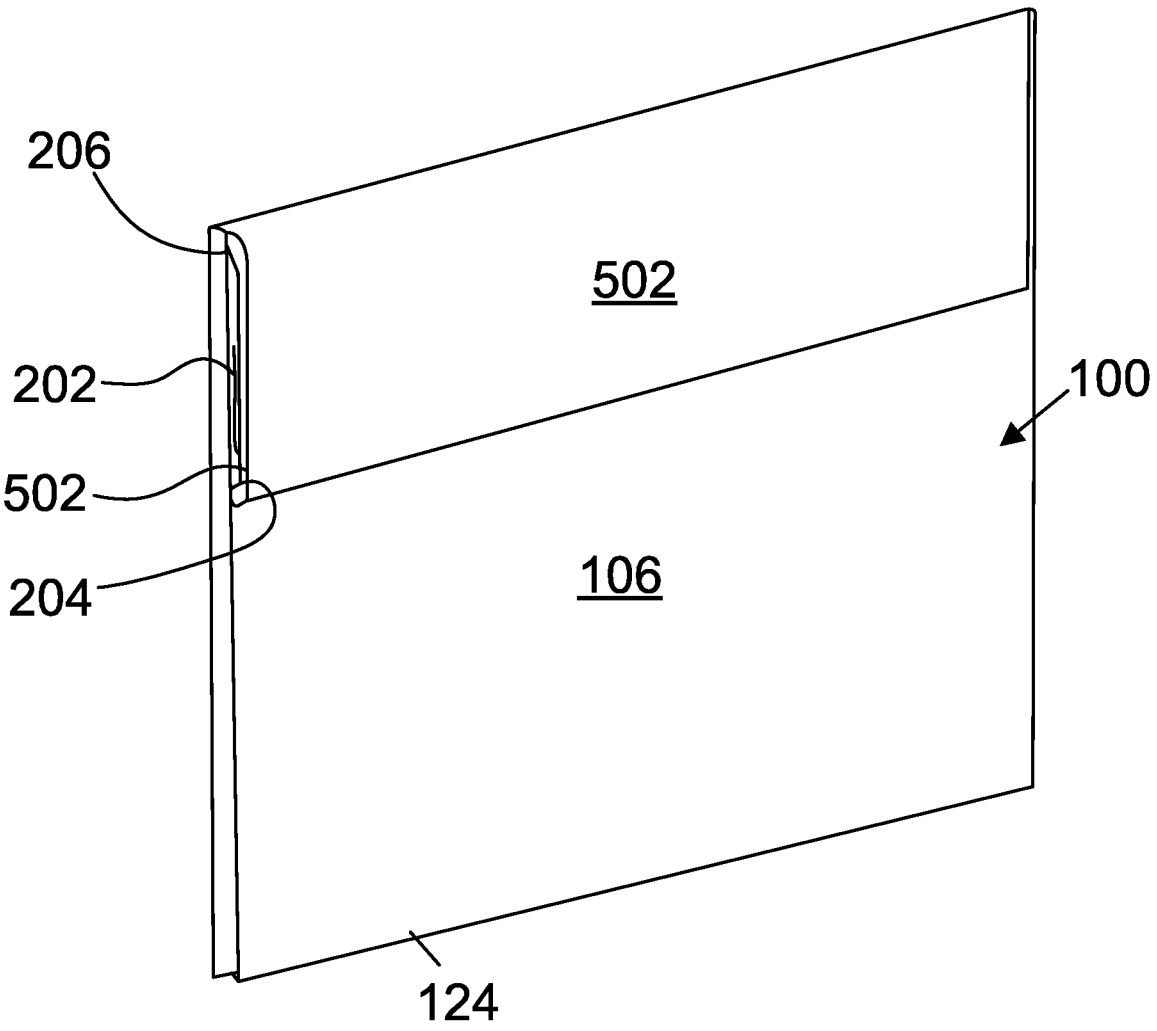
FIG. 7 is an isometric view of the stepped end of the tube of FIG. 6 being folded and sealed.

Further, with reference to FIG. 7, while the adhesive material 600 is in its adhesive state, the tube 100 is folded along a fold line 206 across the tube 100, which folds the bag panel 106 on itself, with the adhesive material layer 600 therebetween. Pressure is applied until an adhesive seal forms by the adhesive material, which is below the fold line 206 and which is between the folded panel 106. The fold line 206 can be free of adhesive material. The fold line 206 is below a portion 202 of the first panel 106 adjacent the stepped end 122, which is free of adhesive material, such that upon folding along the fold line 206, the adhesive material on the first panel 106 below the fold line 206 can form an adhesive seal with the portion 202 of the first panel 106 adjacent the end 122. Further, by folding along the fold line 206, the sealing flap 502 is folded toward the bag section 600 of the panel 106. Pressure is applied against the sealing flap 502 until that adhesive layer 600 forms an adhesive seal of the sealing flap 502. The adhesive seal is established to seal the stepped end 122 with the sealing flap portion 502. In one embodiment of FIG. 6, the fold line 206 is not creased, and the tube 100 is folded without a crease. Alternatively, in FIG. 6, the fold line 206 can be formed as a crease. Then, the flattened and creased tube 100 is conveyed through the adhesive applicator 702 of the apparatus 400.

Figure 8:
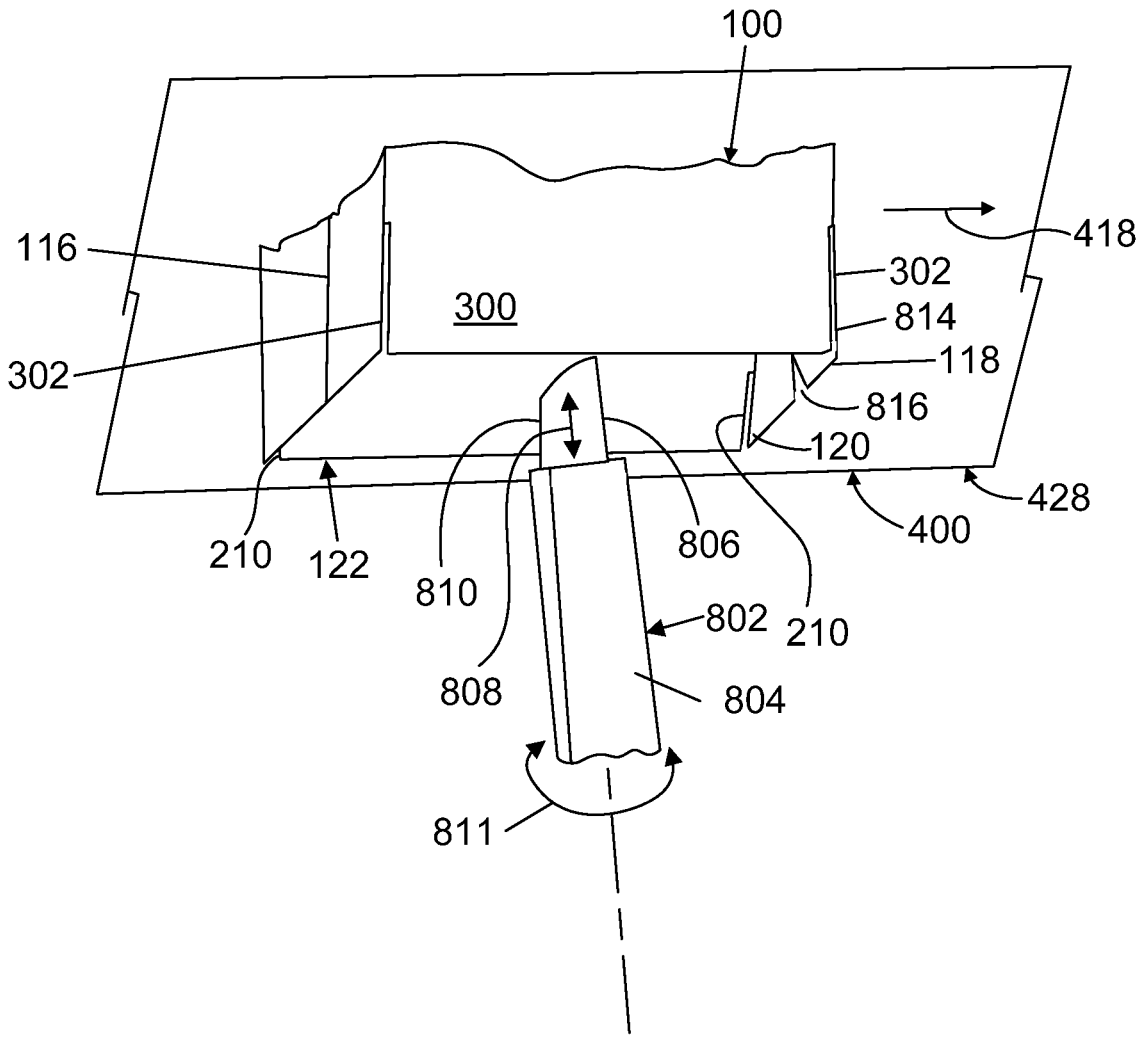
FIG. 8 is an isometric view of a slitting station for slitting side gusset folds on the tube of FIG. 2A.

FIG. 8 discloses an embodiment of the apparatus 100 for making a stepped end 122, FIG. 2A, and more particularly, a double stepped end 122. FIG. 8 discloses a slitting station 802 of the apparatus 400. The tube 100 is conveyed, for example, by a continuous or intermittent or segmented belt conveyor 428, and is indexed into position in front of the slitting station 802 for slitting the side gusset folds 116.

For purposes of illustration, FIG. 8 discloses the tube 100 having the slits 210 and 302. The slits 210 and 302 were provided previously by the slitting station 402. Alternatively, the slits 210 and 302 would not be present in FIG. 8, in an embodiment of the invention wherein the slitting station 402 is in a sequence following the slitting station 802. Further, for purposes of illustration, FIG. 8 discloses the open end 122 of the tube 100 being opened, in a manner similarly as in FIG. 3. Alternatively, the open end 122 can be closed, at least partially, by folding, at least partially, along the gusset folds 116 of both side gussets 110. The gusset folds 116 become slitted according to the description that follows.

FIG. 8 discloses the slitting station 802 of the apparatus 400 is provided with a slitting tool 804 disclosed in its home position. The slitting tool 804 has a retractable, slitting blade 806 that retracts into the tool 804, as indicated by the arrow 808, and alternately, extends to project from the tool 804 to perform a slitting operation. The slitting blade 806 has a sharpened, single slitting edge 810. Further, either the slitting blade 806 or the tool 804 is reversely rotatable 180° as indicated by the arrow 812 to face the slitting edge 810 either in a forward direction indicated by the arrow 418 or in a rearward direction opposite the forward direction. Alternatively, another slitting edge 810 is on the slitting blade 806 to provide a double edge blade 806, not shown, in order to eliminate a need for rotation of the blade 806.

In FIG. 8, the tube 100 is being conveyed or displaced in a forward direction indicated by the arrow 418, such that a leading edge 814 of the tube is displaced past the slitting tool 804 while the slitting edge 810 facing in a rearward direction, projects from the tool 804 and slits through the gusset fold 116 to provide a first gusset slit 816 in the gusset fold 116 at the leading edge 814. The first gusset slit 816 divides the gusset 110 at the open end 122 into a first slitted gusset portion 118 and a slitted gusset portion 120.

Figure 8A:
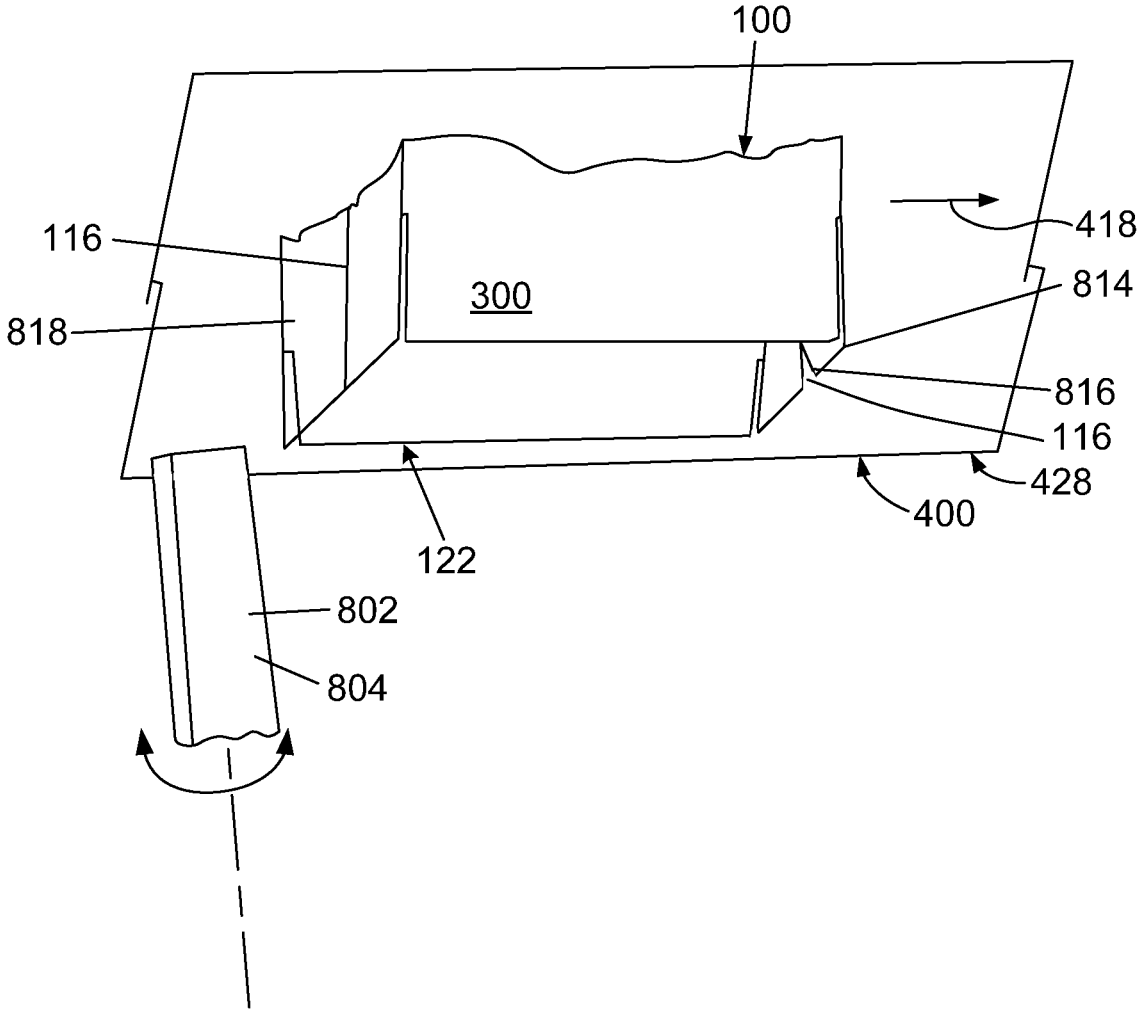
FIG. 8A is a view similar to FIG. 8 indicating an operation of the slitting station of FIG. 8.

As disclosed by FIG. 8A, after cutting the first gusset slit 816, the slitting blade 806 retracts into the tool 804, while the tube 100 continues to be displaced in the forward direction 418 until a trailing edge 818 of the tube 100 is displaced past the tool 804 having the retracted slitting blade 806.

Figure 8B:
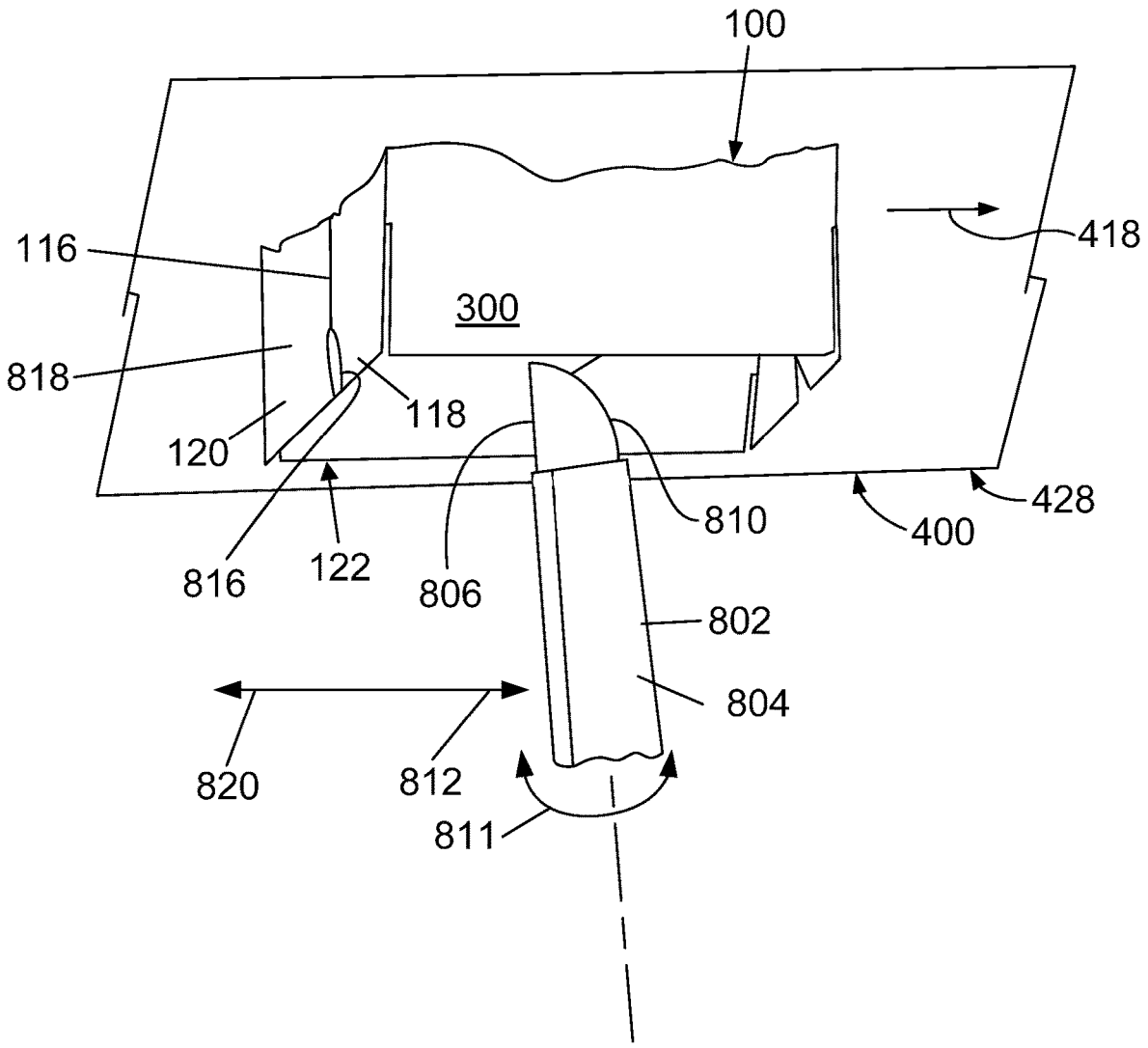
FIG. 8B is a view similar to FIG. 8 indicating another operation of the slitting station in FIG. 8.

As disclosed by FIG. 8B, after a trailing edge 818 of the tube 100 is displaced past the tool 804, the slitting blade 806 is extended to project from the tool 804, and simultaneously, or in sequence, the slitting blade 806 is reversed in direction to face the slitting edge 810 in the forward direction 418. Further, the tool 804 is displaced in a forward direction indicated by an arrow 812 faster than the tube 100 is being conveyed in the forward direction 418, while the slitting edge 810 cuts through the gusset fold 116 at the trailing edge 818 of the tube 100 to provide a second gusset slit 816 in the gusset fold 116 at the trailing edge 818. The second gusset slit 816 divides the gusset 110 at the open end 122 into a first slitted gusset portion 118 and a slitted gusset portion 120. Thus, both gussets 110 are divided into a first slitted gusset portion 118 and a second slitted gusset portion 120. Then the blade 806 retracts, and the tool 804 is displaced rearward, indicated by the arrow 820 to return to its home position, as disclosed by FIG. 8. At the returned home position, the blade 806 is extended outward from the tool 804, and is reversed in direction to face the slitting edge 810 in a rearward direction, while another tube 100, in succession to a prior tube 100, is conveyed or displaced in a forward direction indicated by the arrow 418, such that a leading edge 814 of said another tube 100 in succession is displaced past the slitting tool 804 while the slitting edge 810 facing in a rearward direction, projects from the tool 804 and slits through the gusset fold 116 to provide a first gusset slit 816 in the gusset fold 116 at the leading edge 814. By repeating the operation of the apparatus 400 as described herein, multiple tubes 100 in succession are provided with a pair of gusset slits 816, 816.

According to the following description, the tube 100 having the gusset slits 816, 816 is provided with a stepped end, wherein the stepped end is disclosed by FIG. 2A. First, the tube 100 is conveyed to the first panel trimming station 500, FIG. 4, wherein the first panel 106 is trimmed to a first shortened length 124 disclosed in FIG. 2A. Further, FIG. 2A discloses that the first shortened length 124 of the first panel 106 will be adjacent to the open end 122 of the tube 100. Then the tube 100 is conveyed to the second panel trimming station 604 in consecutive order. At the second panel trimming station 604, each of the side gussets 110, 110 is trimmed to a second shortened length 126, FIG. 2A. Further, FIG. 2A discloses that the second shortened length 126 of each of the side gussets 110, 110 will be adjacent to the open end 122 of the tube 100.

Figure 9:
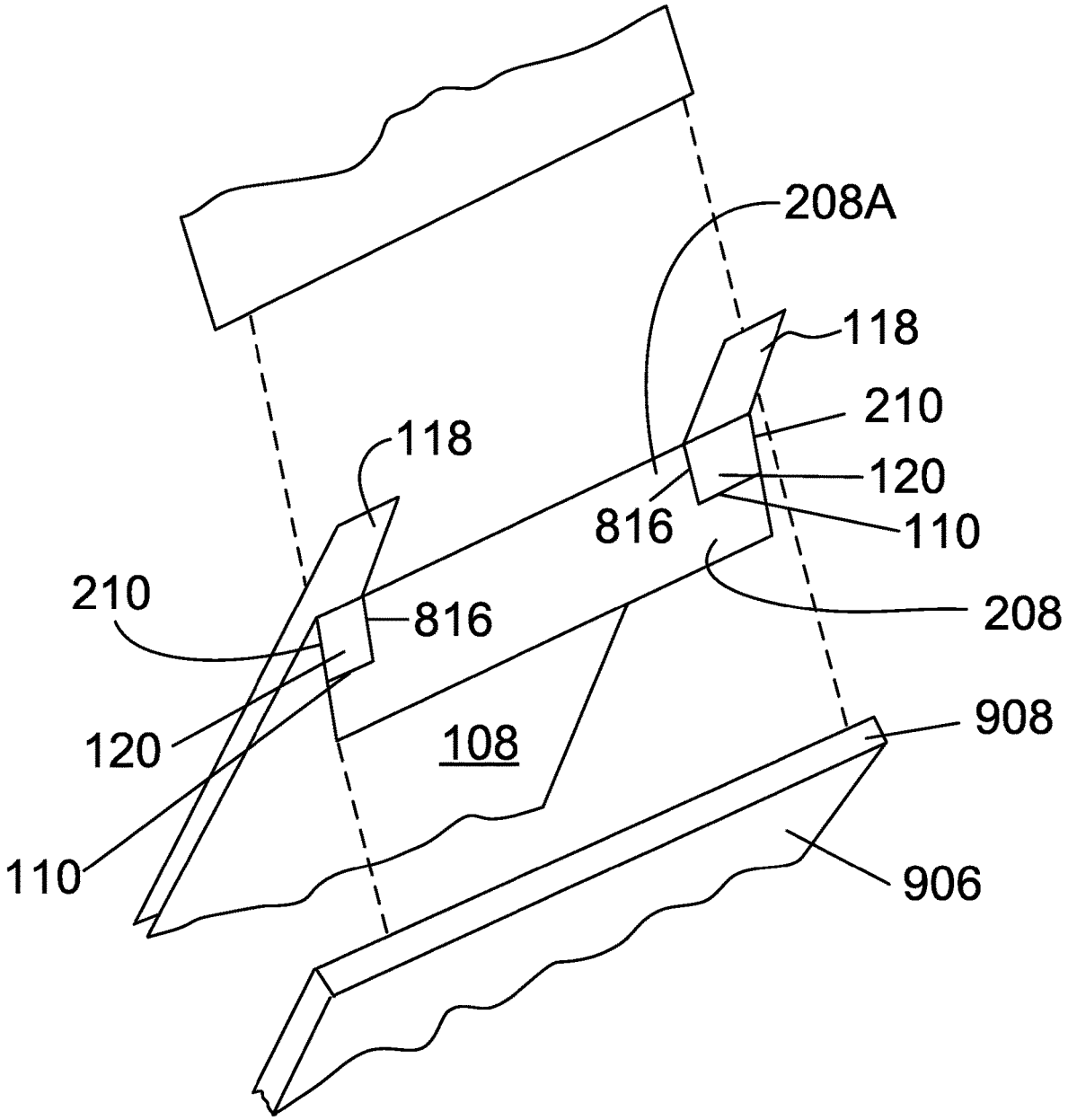
FIG. 9 is a view similar to FIG. 5 indicating a gusset trimming station.

Then, the embodiment of the tube 100 having the gusset slits 816, 820 is conveyed from the second panel trimming station 604 to a gusset trimming station 900, FIG. 9. At the gusset trimming station 900, FIG. 9, the tube 100 is supported on a table or rotary knife anvil 906. The tube 100 is folded along an edge 908 of the table 904, which folds, down and away, the slitted portion 208 of second panel 108, which now includes an additional slitted portion 208A. Further, such folding additionally folds the slitted portions 120, 120 of the two gussets 110, 110 down and away from the slitted portions 118, 118 of the two gussets 110, 110. Each slitted gusset portion 120 is separated from the slitted gusset portion 118 by having the slits 210, 210 and the gusset slits 116, 116. The gusset trimming station 904 includes a cutting blade 910 which cuts through both slitted gusset sections 118, 118, and performs trimming to reduce the height of the gusset sections 118, 118, as disclosed by FIG. 2A, wherein the gusset sections 118, 118 have a height shorter than the gusset sections 120, 120, and have a height longer than the front panel 106 adjacent the end 122 of the tube 100 that becomes a stepped end 122 of the tube 100. Further, the stepped end 122 in FIG. 2A becomes a double stepped end 122, because of the double steps in the gussets 110.

After formation of the double stepped end 122 of the tube 100, the tube 100 is flattened by inwardly folding the side gussets 110, 110. To form a crease along the fold line 206, the flattened tube 100 is conveyed through the scoring apparatus 700 of the apparatus 400, which provides a crease along the fold line 206 across the tube 100. Further, FIG. 6 discloses a method of making a tube 100 of flexible material with a stepped end 122 that folds to close the stepped end 122 and form a bag, and adhesive material layer 600 for sealing the stepped end 122. FIG. 6 discloses a process of applying an adhesive material layer 600 on the first panel 106 of the tube 100 below the fold line 206. The adhesive material layer 600 is applied, while the tube 100 is flat, by an adhesive material applicator 702. Above the fold line 206 is at least a portion 202 of the first panel 106 adjacent the end 124 of the first panel 106 and adjacent the stepped end 122, such that upon folding along the fold line 206, the portion 202 of the first panel 106 adjacent the end 122 can form an adhesive to adhesive seal with the adhesive material below the fold line 206.

The invention provides a method and a system for making an end 122 on a tube of flexible material into a stepped end 122, wherein the stepped end is adapted to be closed and sealed to make a bag. The invention is described in conjunction with a tube 100 having an open end 122 and an opposite end 128. A stepped end 122 according to the invention can be provided on either end 122 or 128. Stepped ends 122, 122 according to the invention can be provided on tube ends 122 and 128, respectively.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A process for preparing a bag comprising the steps of:

slitting a tube of flexible material adjacent an open end of the tube to provide first slits beside a first panel of the tube and to provide second slits beside a second panel of the tube;

trimming the first panel to a first shortened length adjacent to the open end of the tube while the first slits separate the first panel from a remainder of the tube, wherein the remainder of the tube comprises side gussets and the second panel;

trimming each of the side gussets to a second shortened length adjacent to the open end of the tube while the second slits separate each of the side gussets from the second panel, wherein the second shortened length is longer than the first panel and shorter than the second panel; and applying adhesive material on the tube wherein the tube is adapted to be folded along a fold line of the tube, which folds the first panel upon itself with the adhesive material therebetween, and the adhesive material is adapted to form an adhesive bond and an adhesive seal to a portion of the first panel and the side gussets and the second panel, and provide a closed stepped end for the bag, wherein the tube has a woven inner layer comprising a polymeric material, and at least one outer layer of a printable nonwoven polymeric material, and wherein the printable nonwoven polymeric material is a polypropylene film capable of being printed with graphics using water based pigments or solvent based pigments, the outer layer is reverse printed on an inside surface of a first polypropylene film, and a second layer of polypropylene film is laminated to the first polypropylene film, with the printed surface between the first and second layers of polypropylene film, and the inner layer consists of a flexible, woven seamless tube.

2. The process of claim 1, wherein the adhesive material is applied above the fold line of the tube.

3. The process of claim 1, wherein the adhesive material is applied below the fold line of the tube.

4. The process of claim 1, wherein the adhesive material is applied above and below the fold line of the tube.

5. The process of claim 1, wherein the polymeric material is polypropylene.

* * * * *